US005265989A

United States Patent [19]

Stöck

[11] Patent Number: 5,265,989

[45] Date of Patent: Nov. 30, 1993

[54] DRILLING AND CHISELING BIT WITH A CUTTING MEMBER IN A BASE MEMBER

[75] Inventor: Maximilian Stöck, Azmoos, Switzerland

[73] Assignee: Hilti Aktiengesellschaft, Furstentum Liechtenstein, Liechtenstein

[21] Appl. No.: 875,065

[22] Filed: Apr. 28, 1992

[30] Foreign Application Priority Data

May 2, 1991 [DE] Fed. Rep. of Germany ..... 4114271

[51] Int. Cl.[5] ..... B23B 51/00

[52] U.S. Cl. ..... 408/227; 175/420.1; 175/426

[58] Field of Search ..... 125/36; 175/395, 415, 175/420.1, 426, 428, 435; 408/199, 144, 227, 230, 231, 143

[56] References Cited

U.S. PATENT DOCUMENTS 2,614,813 10/1952 Shepherd ..... 175/420.1

FOREIGN PATENT DOCUMENTS 631619 11/1961 Canada ..... 175/420.1
671959 2/1939 Fed. Rep. of Germany ... 175/420.1
136911 8/1952 Sweden ..... 175/420.1
707021 4/1954 United Kingdom ..... 175/426

*Primary Examiner*—Daniel W. Howell
*Attorney, Agent, or Firm*—Anderson Kill Olick & Oshinsky

[57] ABSTRACT

A drilling and chiseling bit includes a base member (1) having an axis extending in the drilling and chiseling direction. The base member has an end face disposed transversely of the axis, with a recess (3) extending in the axially direction inwardly from the end face. A cutting member (2) is secured in the recess by a soldered joint. At least one of the base member and cutting member is formed to prevent the development of shear stress peaks in the end regions of the recess extending transversely of the axial direction. To prevent the shear stress peaks, relief notches or recesses can be provided in the base member (1) or the soldered joint (4) can have a variable thickness in the axial direction increasing towards the opposite ends of the recess.

7 Claims, 2 Drawing Sheets

DRILLING AND CHISELING BIT WITH A CUTTING MEMBER IN A BASE MEMBER

BACKGROUND OF THE INVENTION

The present invention is directed to a drilling and chiseling bit with an axially extending steel base member and a hard metal cutting member secured in a recess in the base member. The base member has an end face extending transversely of the axial or drilling direction and the recess extends inwardly from the end face. The recess has oppositely disposed side walls extending parallel to the axis of the base member and an end wall located inwardly of the end face extending transversely of the axis.

Drilling and chiseling bits, of the type mentioned above, have been in wide use for many years and have been found to be effective. Problems arise with such bits, however, due to the considerably different properties of the steel used for the base member and the hard metal used in the cutting member. These problems can develop during manufacture and also when the bits are used.

Among the problems experienced in manufacture are the thermal stresses caused by the different coefficients of thermal expansion of the materials forming the bit. To deal with such problems, it has been proposed in DE-OS 34 26 977 to provide the recess in the base member with a greater length as compared to the cutting member.

Such a solution does not solve the considerably greater problems encountered when the tool bits are used. Problems arise during use of the bits, because of the wide differences in the moduli of elasticity of the materials causing excessive stresses and resulting in damage affecting the useful life of the bit. The excessive stresses result primarily from the shear stresses which differ greatly along the axis or in the drilling direction of the bit, and such stresses reach their peak values at the opposite ends of the recess in the axial direction. Consequently, in the region of the opposite ends, the soldered joint securing the cutting member to the base member is damaged along with damage to the base member and the cutting member.

SUMMARY OF THE INVENTION

The primary object of the present invention is to provide a drilling and chiseling bit where the peak stresses of the individual parts encountered during use are avoided and the useful life of the bit is increased.

In accordance with the present invention, a soldered joint is provided in the region of the side walls of the recess for connecting the cutting member to the base member which affords a uniform distribution of the shear stresses along the axial length of the recess.

The invention applied to a drilling and chiseling bit limits shear stress peaks in the region of the ends of the recess spaced apart in the axial direction. As a result, a uniform distribution of the shear stresses in the soldered joint forming the connection between the base member and the cutting member is created along the axial direction of the recess. Accordingly, excess stresses, which would tend to destroy the soldered joint as well as the adjacent regions of the base member and the cutting member, are avoided.

In one preferred embodiment, the soldered joint has a variable thickness along the axial length of the recess for affording uniform distribution of the shear stresses.

The joint thickness is varied so that it increases towards both of the ends of the recess. As a result, the soldered joint is thicker in those regions where the highest shear stresses occur. In these end regions, more solder material is available, whereby the end regions are better able to equalize the shear stresses and thus limit the peak stress values.

A soldered joint of variable thickness can be achieved in various ways. Initially, the variable thickness can be provided by an appropriate shaping of the cutting member with a slightly convex side surface in the axial direction, or the side wall of the recess can have a similar shape, that is, a slightly convex configuration in the axial direction. Further, it is possible to combine these two features.

As a separate way of adjusting the shear stresses, or as a supplement to the above arrangement of the soldered joint, appropriate means can be employed in the base member. The means in the base member can consist in the arrangement of relief notches located in the region of the recess and preferably extending perpendicularly to the axis of the base member and parallel to the side walls of the recess. Such relief notches afford a certain yielding or flexibility of the base member in the critical regions, that is, in the region of the opposite ends of the recess.

In one embodiment, the relief notches can be formed as bores extending through the base member in the region of the inner end of the recess spaced inwardly from the end face forming the drilling end of the bit. Such bores provide the base member with a certain flexibility in the inner region of the recess. As a result, shear stress peaks can be reduced or decreased and the soldered joint possibly present in the inner end of the recess is relieved so that fractures can no longer occur.

In another embodiment, it is possible to form the relief notches as a recess extending along the inner end of the recess, that is, inwardly from the drilling end of the bit. Such an arrangement provides a certain flexibility for the base member which results in the avoidance of stress peaks.

For limiting the shear stress peaks in the drilling end region, relief notches in the form of open grooves can be provided. Preferably, such grooves extend parallel to the cutting member in the drilling end face of the tool. Applying the knowledge that the shear stress peaks will be decreased in relation to the ratio of the thickness of the cutting member to the thickness of the base member between the cutting member and the grooves, the wall thickness of the base member between the recess and the groove is in the range of 0.1 to 0.8 times the width of the recess. Accordingly, flexibility of the base member for limiting the shear stress peaks is achieved in the drilling end face of the base member adjacent the recess.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described the preferred embodiments of the invention.

DETAILED DESCRIPTION OF THE INVENTION

Figure 1:
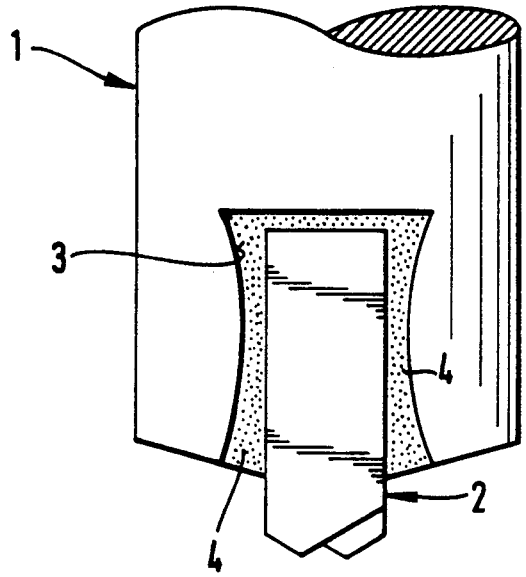
FIG. 1 is a partial elevational view of the drilling end of a drilling and chiseling bit embodying the present invention with a soldered joint of variable thickness.

FIG. 1 shows the drilling end of a drilling and chiseling bit with a base member 1 and a cutting member 2. The base member 1 is formed of steel and the cutting member is formed of a hard material, that is, a material harder than steel. The base member has an axial direction extending in the drilling direction of the bit, that is, in the downward direction as viewed in FIG. 1. The base member 1 has a recess 3 extending inwardly from the end face in the axial direction. A soldered joint 4 is located in the recess 3 for securing the cutting member 2 to the base member 1.

As can be seen in FIG. 1, the soldered joint 4 has a variable thickness in the axial direction of the base member 1, with the thickness being greatest at the opposite ends of the recess in the axial direction, with the soldered joint having the least thickness intermediate the ends of the recess in the axial direction. The variable thickness of the soldered joint 4 is achieved in this embodiment by shaping the axially extending side walls of the recess 3 with a slightly convex shape, whereby the thickness or width of the soldered joint 4 is smallest intermediate the ends of the recess.

Figure 2:
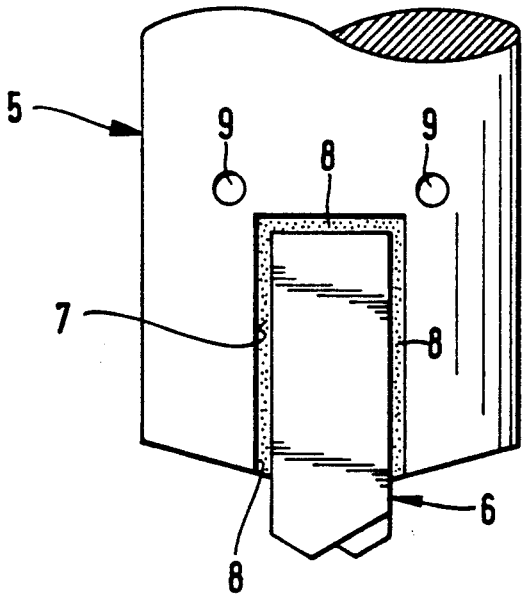
FIG. 2 is a partial elevational view of the drilling end of the tool bit with transverse bores.

In FIG. 2, the drilling end of a drilling and chiseling bit is made up of a base member 5 with a recess 7. A cutting member 6 is secured in the recess 7 by a soldered joint 8. As in FIG. 1, the soldered joint is located between the cutting member 6 and the side walls and inner end wall of the recess 7. Bores 9 extend through the base member 5 spaced inwardly from the inner end wall of the recess 7. Further, the bores are spaced slightly outwardly from the inner end wall of the recess 7.

Figure 3:
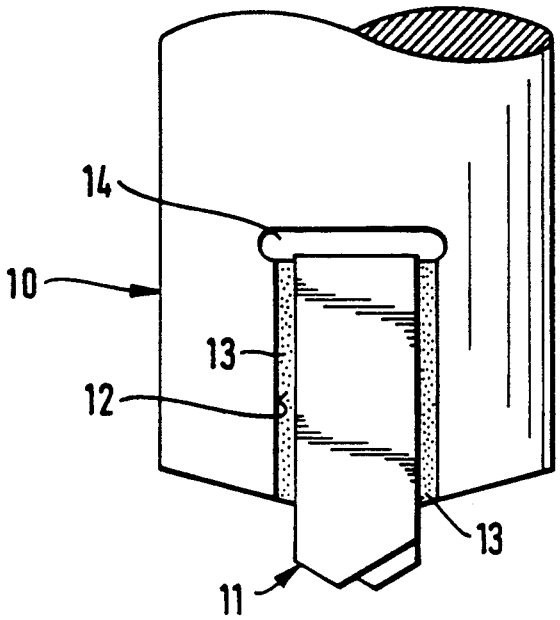
FIG. 3 is a partial elevational view of the drilling end of the drilling and chiseling bit with a cutout or undercut portion.

In FIG. 3, another embodiment of the present invention is displayed, with the drilling and chiseling bit formed by a base member 10, with a cutting member 11 secured within a recess 12 in the base member. The recess extends axially inwardly from the drilling end face of the bit. A soldered joint 13 secures the cutting member 11 within the recess 12 to the base member 10. As distinguished from the embodiments of FIGS. 1 and 2, the soldered joint 13 does not extend across the inner end wall of the recess, but secures the cutting member 11 to the base member 10 along the side walls of the recess. A cutout or recess 14 is located in the base member 10 along the inner end wall of the recess extending perpendicularly to the axis for providing relief notches. The recess 14 penetrates into the base member 10. Due to the recess 14, the soldered joint 13 is not located at the inner end of the recess 12.

Figure 4:
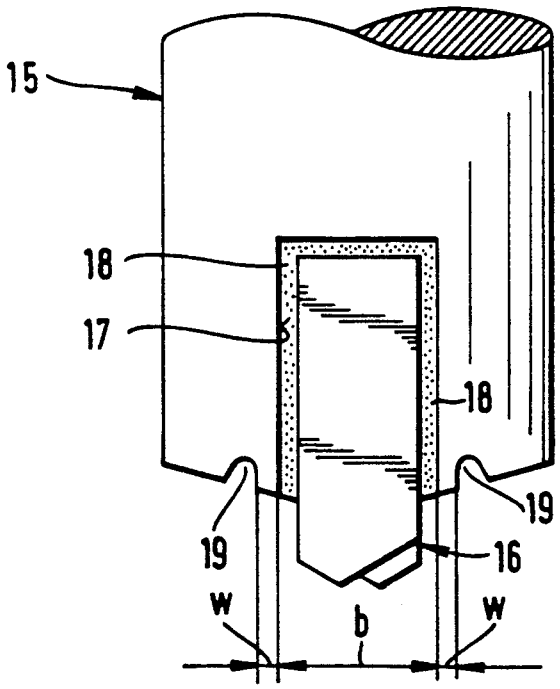
FIG. 4 is a partial elevational view of the drilling end of the drilling and chiseling bit with grooves in the drilling end face of the bit.

Still another embodiment of the present invention is displayed in FIG. 4 where the drilling end of the drilling and chiseling bit is formed by a base member 15 containing a recess 17 in which a cutting member 16 is secured. A soldered joint 18 extending along the side walls and end wall of the recess secures the cutting member 16 to the base member 15. The drilling end face of the base member 16 has grooves 19 extending into the end surface and spaced from and disposed parallel to the side walls of the recess 17. A wall thickness w remains between the side walls of the recess and the grooves 19. Wall thickness w is smaller than the width b of the recess 17, whereby the wall thickness w is in the range of 0.1 to 0.8 times the width b of the recess 17.

In the embodiments shown in the drawings, different means are provided for solving the problem to which the present invention is directed. The means of each embodiment can be incorporated individually into a drilling and chiseling bit or can be used in a suitable mutual combination, whereby in combination there is the advantage that the effects of the embodiments are cumulative.

While specific embodiments of the invention have been shown and described in detail to illustrate the application of the inventive principles, it will be understood that the invention may be embodied otherwise without departing from such principles.

I claim:

1. Drilling and chiseling tool comprising a base member (1, 5, 10, 15) formed of steel and having an axis extending in a drilling and chiseling direction and an end face extending transversely of the axis and facing in the drilling or chiseling direction; said base member having a recess (3, 7, 12, 17) therein extending inwardly in the axial direction from the end face, a cutting member (2, 6, 11, 16) formed of a hard metal set in said recess, said recess comprises side walls extending substantially parallel to the axis and an end wall spaced inwardly from the end face and extending transversely of the axis, wherein the improvement comprises a soldered joint (4, 8, 13, 18) securing the cutting member (2, 6, 11, 16) to said base member (1, 5, 10, 15) in said recess, and means in at least one of said base member and cutting member for providing a uniform distribution of shear stress in the axial direction of the base member between said cutting member and base member, said means comprises that said side walls are convexly shaped in the axial direction, said cutting member has planar side walls facing and spaced from said recess side walls so that said soldered joint (4) has a variable thickness in the axial direction of said base member, and the thickness of the soldered joint (4) increases continuously from a minimum at a point intermediate the end wall of the recess and the end face of the base member to a maximum at the end wall of the recess and at the end face of the base member.

2. Drilling and chiseling bit, comprising a base member (1, 5, 10, 15) formed of steel and having an axis extending in a drilling and chiseling direction and an end face extending transversely of the axis and facing in the drilling or chiseling direction; said base member having a recess (3, 7, 12, 17) therein extending inwardly in the axial direction from the end face, a cutting member (2, 6, 11, 16) formed of a hard metal set in said recess, said recess comprises side walls extending substantially parallel to the axis and an end wall spaced inwardly from the end face and extending transversely of the axis, wherein the improvement comprises a soldered joint (4, 8, 13, 18) securing the cutting member (2, 6, 11, 16) to said base member (1, 5, 10, 15) in said recess, and means in at least one of said base member and cutting member for providing a uniform distribution of shear stress in the axial direction of the base member between said cutting member and base member, said means comprises that relief notches are provided in the base member (5, 10, 15) in the region of at least one of the end wall of the recess and end face of the base member with the relief notches extending perpendicularly to the axis of the base member and parallel to the side walls of the recess, the relief notches are bores (9) extending through the base member (5) in the region of the end wall of the recess (7) with said bores extending parallel to said side walls, said bores are located in said base member more remote from the end face thereof than said end wall of said recess, and said bores are free of direct communication through said base member with said recess.

3. Drilling and chiseling bit, comprising a base member (1, 5, 10, 15) formed of steel and having an axis extending in a drilling and chiseling direction and an end face extending transversely of the axis and facing in the drilling or chiseling direction; said base member having a recess (3, 7, 12, 17) therein extending inwardly in the axial direction from the end face, a cutting member (2, 6, 11, 16) formed of a hard metal set in said recess, said recess comprises side walls extending substantially parallel to the axis and an end wall spaced inwardly from the end face and extending transversely of the axis, wherein the improvement comprises a soldered joint (4, 8, 13, 18) securing the cutting member (2, 6, 11, 16) to said base member (1, 5, 10, 15) in said recess, and means in at least one of said base member and cutting member for providing a uniform distribution of shear stress in the axial direction of the base member between said cutting member and base member, said means comprises that relief notches are provided in the base member (5, 10, 15) in the region of at least one of the end wall of the recess and end face of the base member with the relief notches extending perpendicularly to the axis of the base member and parallel to the side walls of the recess, said relief notches are formed by a recessed cutout (14) penetrating into said base member (10) and extending along the end wall of the recess (12).

4. Drilling and chiseling bit, as set forth in claim 3, wherein said soldered joint extends only along the side walls of the recess between the end face of the base member and the end wall of the recess.

5. Drilling and chiseling bit, comprising a base member (1, 5, 10, 15) formed of steel and having an axis extending in a drilling and chiseling direction and an end face extending transversely of the axis and facing in the drilling or chiseling direction; said base member having a recess (3, 7, 12, 17) therein extending inwardly in the axial direction from the end face, a cutting member (2, 6, 11, 16) formed of a hard metal set in said recess, said recess comprises side walls extending substantially parallel to the axis and an end wall spaced inwardly from the end face and extending transversely of the axis, wherein the improvement comprises a soldered joint (4, 8, 13, 18) securing the cutting member (2, 6, 11, 16) to said base member (1, 5, 10, 15) in said recess, and means in at least one of said base member and cutting member for providing a uniform distribution of shear stress in the axial direction of the base member between said cutting member and base member, said means comprises that relief notches are provided in the base member (5, 10, 15) in the region of at least one of the end wall of the recess and end face of the base member with the relief notches extending perpendicularly to the axis of the base member and parallel to the side walls of the recess, said relief notches are open grooves extending into the end face of said base member.

6. Drilling and chiseling bit, as set forth in claim 5, wherein said open grooves extend generally parallel to the side walls of said recess and are spaced outwardly from the side walls of said recess.

7. Drilling and chiseling bit, as set forth in claim 6, wherein a wall thickness (w) of said base member (15) located between the side wall of the recess (17) and the grooves (19) is in the range of 0.1 to 0.8 times a width (b) of the recess (17) extending between the side walls thereof.

* * * * *